United States Patent [19]

Krasuski et al.

[11] Patent Number: 5,000,432

[45] Date of Patent: Mar. 19, 1991

[54] FOLDER HAVING POCKETS

[75] Inventors: Marek Krasuski, Fontenay aux Roses; Bernard Prugnolle, Pantin, both of France

[73] Assignee: Alcatel Satmam, Bagneux, France

[21] Appl. No.: 380,342

[22] Filed: Jul. 17, 1989

[30] Foreign Application Priority Data

Jul. 27, 1988 [FR] France ..... 88 10119

[51] Int. Cl.[5] ..... B42C 1/00

[52] U.S. Cl. ..... 270/45; 493/420; 493/421

[58] Field of Search ..... 270/5, 45–51, 270/16, 17; 493/405, 409, 419–420

[56] References Cited

U.S. PATENT DOCUMENTS 3,901,501 8/1975 Kistner .
4,573,672 3/1986 Lehmann ..... 270/45
4,619,101 10/1986 Havey ..... 493/421

FOREIGN PATENT DOCUMENTS 157349 10/1985 European Pat. Off. ..... 493/421
61-2669 1/1986 Japan ..... 493/421

*Primary Examiner*—John T. Kwon
*Assistant Examiner*—Therese M. Newholm
*Attorney, Agent, or Firm*—Sughrue, Mion, Zinn Macpeak & Seas

[57] ABSTRACT

The folder comprises a top portion (5A) which is openable relative to a bottom portion (5B). It has a first pocket (2) in the top portion, a second pocket (3) in the bottom portion, and a set (4) of folding rollers. The top and bottom portions are constituted by respective frames and the set of rollers is mounted in part in the top portion and in part in the bottom portion. The outlet path (11) for folded documents runs between the top and bottom portions. This provides wide open access to the paper paths inside the folder in the event of a jam.

10 Claims, 4 Drawing Sheets

FOLDER HAVING POCKETS

The present invention relates to a folder having pockets, the folder being intended for automatically folding documents to be put into envelopes.

BACKGROUND OF THE INVENTION

Folders having pockets are well known per se and already widely used in installations for automatically processing mail. The commonest varieties have two pockets for folding the documents they receive in three by forming two folds in the documents.

In order to form each fold, each pocket co-operates with three folding rollers. One of these three rollers, referred to as the "first" roller is disposed tangentially to the other two rollers. The pocket in question has an open end for document access mounted between the two second rollers and facing the first roller.

In operation, one of the second rollers and the first roller insert and advance the document to be folded into the pocket in question. The document comes into abutment inside the pocket while it is still being advanced, thereby forming a buckle in front of the access end of the pocket. The buckle is taken up and captured between the first roller and the other second roller, thereby forming the desired fold and ejecting the document folded in this way.

Some such folders have their two pockets disposed in parallel. A set of five folding rollers is then associated with the two pockets which extend from the same side of the set of rollers. One of the above-mentioned second rollers for each pocket is then used in common for both pockets. It is used for forming the first fold for the first pocket receiving the document, and also for inserting the document into the second pocket, first fold foremost.

Other folders have their two pockets disposed in a non-parallel configuration along the arms of a truncated V-shape, in which case the pockets are associated with a set of four folding rollers. The above-mentioned first roller for each pocket is common to both pockets. There are three other rollers tangentially disposed around its periphery, constituting the above-mentioned second rollers for each pocket, with one of them being common to both pockets. The first roller is then used in common for inserting and advancing the document into the first pocket, for forming the first fold in association with this first pocket, for inserting the document, first fold foremost, into the second pocket, and finally for making the second fold in association with this second pocket and ejecting the document folded in three. These folders with a V-configuration of pockets take up less longitudinal space than do folders having parallel pockets.

In folders having pockets, the pockets themselves are formed by cassettes, or flat boxes, or the like.

One of the small faces of each cassette is open and defines the access end for documents engaging the pocket. At the opposite end to the access end, the small rear wall and/or an internal abutment prevent the document from advancing further into the cassette, thereby serving to form a buckle ahead of the pocket and the fold which results therefrom.

In such folders, it is possible to modify the lengths of the folds to be formed, thus the positions of the fold lines across the documents. This can be done by having an internal abutment in each pocket which is adjustable in position relative to the access opening. It is also possible to make only one fold. In one of the pockets the adjustable or removable internal abutment is then replaced by its small rear wall whereas in the other pocket its access end is closed or the entire pocket is removable from the folder and is replaced by a guide deflector.

Such folders with pockets in the form of cassettes or flat boxes are widely sold. In operation, the main drawback of such folders with pockets lies in the difficulty of clearing such jams as may occur. Jams occur in particular when the documents to be folded together have different dimensional characteristics. Clearing jams is awkward because of difficulties in gaining access to the document path.

Patent document U.S. Pat. No. 4,619,101 describes a folder having two pockets disposed in a V-configuration facing a set of folding rollers. This folder is made compact and operates at a low noise level so as to be usable as an office machine. In addition, provision is made for gaining access to the inside of the pockets when the machine is opened for the purpose of clearing jams.

To achieve this aim, this prior folder is formed inside a two-part housing defining a base and a lid. The lid is pivoted to the rear of the base for the purpose of opening the folder. The set of folding rollers receives the sheets to be folded from an inlet provided in the lid, and it delivers them folded via an outlet provided in the base. In this prior folder, a first one of the two pockets is defined in the lid by a top wall of the lid and by a parallel bottom wall which is pivoted to the lid. The second pocket is defined in the base by a bottom wall of the base and by a parallel top wall which is pivoted to the base.

The top wall of the lid for the first pocket and the bottom wall of the base for the second pocket are integrally molded with the lid and the base. The bottom wall of the first pocket has its rear end which is distant from the set of rollers hinged to the lid; it opens naturally when the lid is raised. The top wall of the second pocket has its front end, close to the set of rollers hinged to the base; its rear end rests on an abutment of the base and it can be opened by hand when the lid is raised. In addition, this top wall of the second pocket carries separator means for holding the bottom wall of the first pocket in place when the lid is closed.

The folder of this prior document provides a partial solution to problems of clearing a jam at the pockets, even though access to the inside of the second pocket remains rather awkward. However, it does not provide open access to the entire document path. In addition, the housing which enables opening pockets to be obtained is complex in shape. Further, it makes access to the components during assembly and maintenance rather awkward and it limits the number of add-on components that it can receive, and consequently constitutes a limiting factor on the design of the folder itself and on its utilization in an integrated and fully automatic folding and insertion machine.

The object of the present invention is to avoid the above-mentioned drawbacks by considerably increasing access to the inside of the folder and by making it easier to manufacture.

SUMMARY OF THE INVENTION

The present invention therefore provides a folder with pockets, the folder comprising two portions, a bottom portion and a top portion hinged to the bottom portion for opening purposes, the folder having an inlet for sheets to be folded in its top portion and an outlet for folded sheets on its bottom portion, the folder comprising:

a set of folding rollers receiving the sheets to be folded from said inlet and delivering them folded on an outlet path leading to said outlet;

a first pocket in the top portion and a second pocket in the bottom portion, each pocket having a sheet access adjacent to said set of rollers;

wherein said folder is constituted by a frame in two portions defining said top portion and said bottom portion of the folder, and said set of rollers has a portion of its rollers mounted in the top portion of the frame and the remainder of its rollers mounted in the bottom portion of the frame, defining said outlet path for folded sheets directly between the top and bottom portions of the frame, said set of rollers coming apart on being opened, and said outlet path opening when the frame is opened.

In addition, in the folder with pockets, in which said first and second pockets are each defined by a fixed wall and a facing pivoting wall for opening the pockets when the top portion of the folder is opened, each of said first and second pockets is constituted substantially identically and independently of its frame portion, by a pair of plates coupled to each other about an end hinge axis opposite from the access to the pocket, and each pocket further includes: fixing first means for fixing that one of the plates of the pocket which constitutes the fixed wall to the frame; resilient second means urging the other plate forming said pivoting wall against the fixed wall; and separating third means for ensuring that the facing faces of each pair of plates do not touch one another.

Advantageously, each pocket includes a set of wheels projecting into the pocket and carried by the plates and making contact with one another inside the pocket.

Each pocket is also fitted with a pivoting finger mounted as an obstacle which is retractable by the document in the pocket in question, said finger being carried by the fixed plate and coupled to an element for directing the document into the pocket and lying outside said pocket.

BRIEF DESCRIPTION OF THE DRAWINGS

An embodiment of the invention is described by way of example with reference to the accompanying drawings, in which.

DETAILED DESCRIPTION

Figure 1:
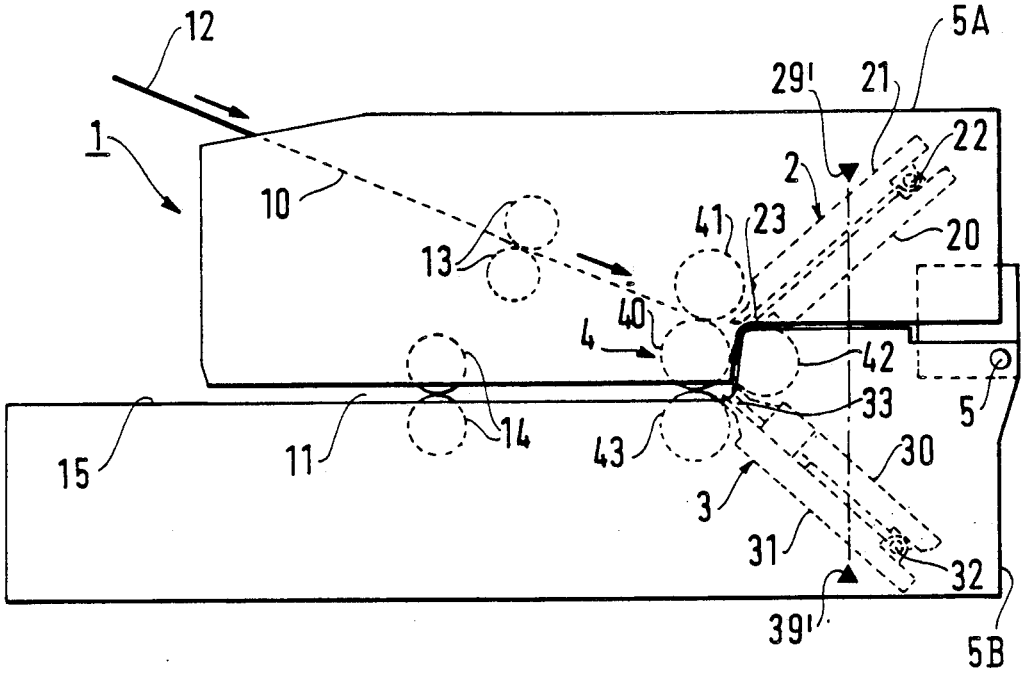
FIG. 1 is a diagrammatic profile view of a folder with pockets and in accordance with the present invention.

The folder with pockets shown in the figures is given overall reference numeral 1. It contains two folding pockets 2 and 3 associated with a set of folding rollers 4.

In this folder, the two pockets 2 and 3 are disposed along the arms of a V-shape truncated at the set of folding rollers 4 which comprises four rollers.

The two pockets 2 and 3 and the set of folding rollers 4 are mounted inside a frame comprising two parts: a top part 5A and a bottom part 5B. The pocket 2 is mounted in the top part 5A and the pocket 3 in the bottom part 5B.

The two pockets 2 and 3 are analogous to each other. Each of them is in the form of a kind of flat cassette into which a document to be folded enters in part.

Each of these pockets is constituted by a pair of plates coupled together and receiving between them the documents to be folded. These plates are referenced 20 and 21 for the pocket 2 and 30 and 31 for the pocket 3.

The plates 20 and 21 are coupled to each other about an end hinge axis 22. When the pocket 2 is mounted in the frame, one of its plates is fixed in the top portion 5A of the frame, while the other plate remains pivotable about the hinge axis 22. This hinge axis is embodied by a shaft defining the end of the pocket furthest from its document access 23 which is adjacent to the set of rollers. The fixed plate is the plate 21; and the pivoting plate is the plate 20 which is on the same side of the fixed plate as is the bottom portion 5B of the frame in which the pocket 2 in question is not mounted.

The pair of plates 30 and 31 for the pocket 3 is mounted in a manner analogous to the pair of plates 20 and 21, but in the bottom portion 5B of the frame. The plate 30 is on the same side as the top portion 5A of the frame and pivots about an axis 32 coupling together the plates 30 and 31 at the end of the pocket 3 opposite to its document access 33. The plate 31 is fixed in the bottom portion 5B of the frame.

The four rollers of the set 4 are referenced 40 to 43. The roller 40 has the other three rollers 41, 42, and 43 placed tangentially to its periphery. Access 23 to the pocket 2 is interposed between peripheral rollers 41 and 42 and faces roller 40. Access 33 to the pocket 3 is interposed between peripheral rollers 42 and 43 and likewise faces the roller 40.

Two of these four rollers are mounted in the top portion 5A of the frame, i.e. the two rollers 40 and 41. The other two rollers 42 and 43 are mounted in the bottom portion 5B.

A feed path 10 for documents to be folded is provided in the top portion 5A of the frame. An outlet path 11 for folded documents is defined between the bottom portion 5B and the top portion 5A of the frame. The document feed path 10 is fed from a document inlet 12. The inlet is fitted with a feed tray for transferring separate successive documents to be folded or else with a magazine and an associated unstacker likewise transferring separate successive documents to be folded. The feed path 10 includes drive means 13 for driving the documents it receives, and it guides them between the rollers 40 and 41. The outlet path 11 includes the rollers 40 and 43, which deliver folded documents, and drive means 14 for driving folded documents to an outlet 15 defined at the front of the folder on the end portion of the bottom portion 5B of the frame.

The drive means 13 and 14 on the paths 10 and 11 are pairs of wheels or the like pressing against each other. They are mounted in the top portion 5A of the frame with respect to the path 10. With respect to the outlet path 11 which is defined between the two portions of the frame, the wheels in the pair are mounted, like the rollers 40 and 43 facing each other and respectively in the top portion 5A and in bottom portion 5B of the frame.

The top portion 5A of the frame is hinged about an end axis 5 on the bottom portion 5B for opening purposes. This axis 5 runs parallel to the hinge axes 22 and 32 of the pivoting plates in the pockets. It extends substantially between these axes at the opposite end of the folder to its outlet 15. The top portion 5A of the frame can be latched to the bottom portion 5B of the frame by any appropriate means, not shown.

Figure 2:
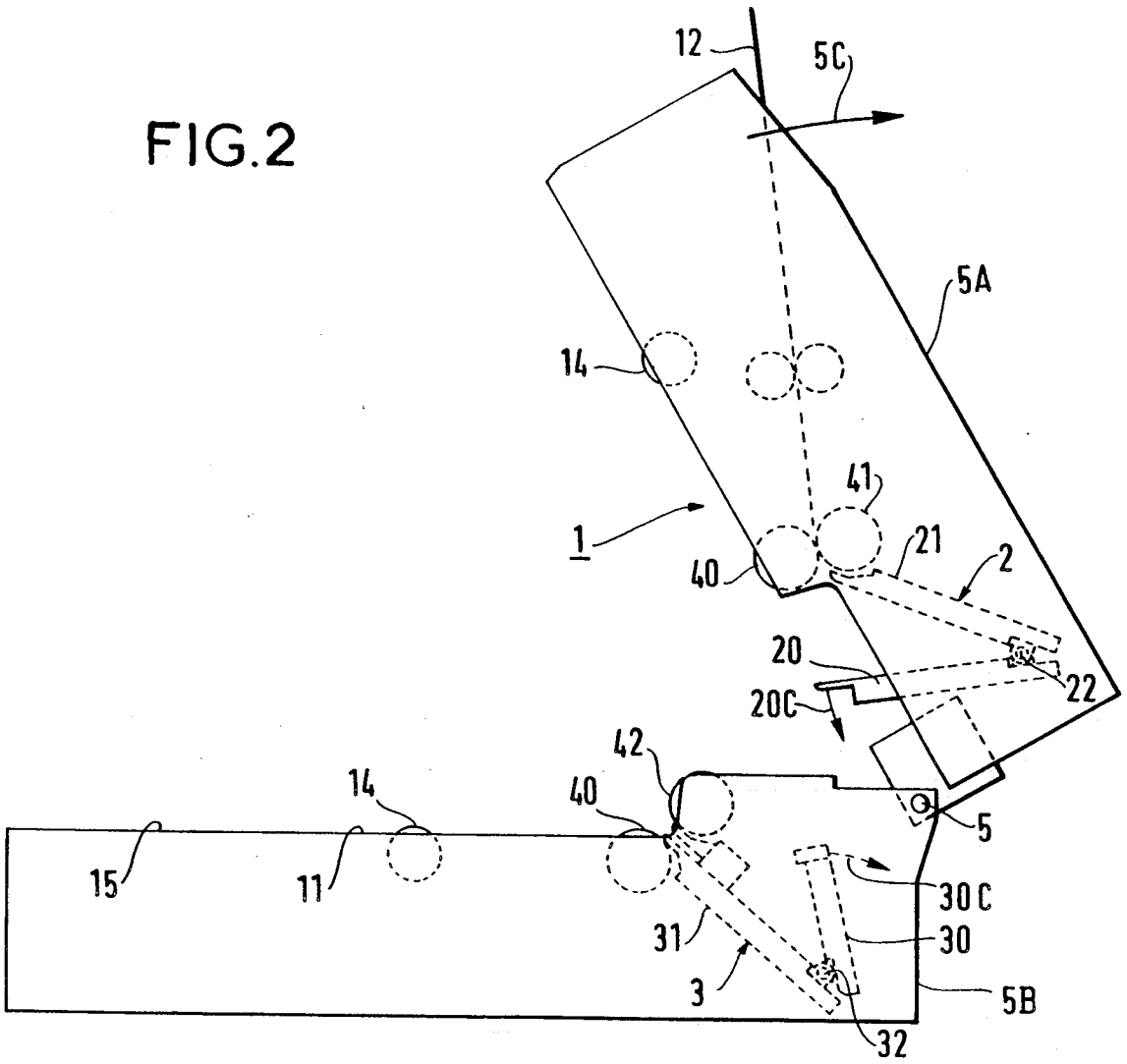
FIG. 2 shows the FIG. 1 folder in its open position.

The folder of the invention is shown closed in FIG. 1 and open in FIG. 2 in order to show its advantages directly.

In FIG. 2, the folder is opened by pivoting the top portion 5A of the frame about its axis 5 in the direction of arrow 5C. Opening the folder in this way gives direct access to the folded document outlet path 11 which is open over its entire length. It also gives very easy access to the feed path 10 through the open bottom face of the top portion 5A of the frame.

The structure of the pockets in which each comprises a fixed plate and a pivoting plate with the pivoting plate being mounted adjacent to that portion of the frame which does not contain the pocket in question means that opening the folder makes it possible to open one and/or the other pocket in order to gain free access to the entire inside volume of each of them. Arrow 20C shows how the pivoting plate 20 can be pivoted about axis 22 in order to open the pocket 2. Arrow 30C represents the same operation for the pocket 3.

The set of folding rollers is disassembled and thus opened by opening the folder and therefore does not constitute an obstacle to clearing a jam which may have occurred between the roller 40 and the rollers 41, 42, and 43.

Figure 3:
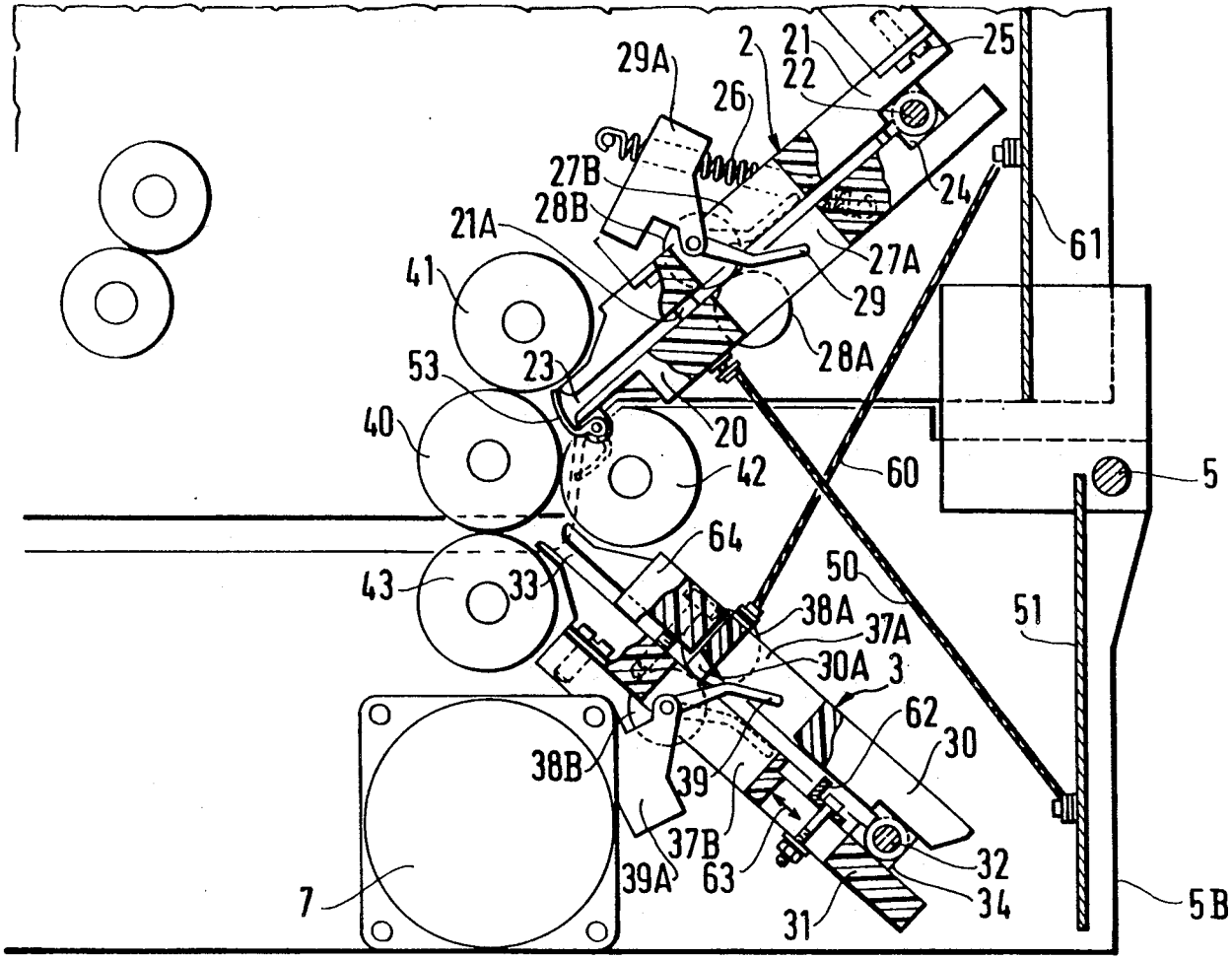
FIG. 3 is a partially cut-away diagrammatic view on a larger scale showing the portion of the FIG. 1 folder containing its pockets.

The structure and mounting of the pockets associated with the set of folding rollers are described in greater detail with reference to the embodiment shown in FIG. 3. In FIG. 3, items which have already been described with reference to FIG. 1 are designated using the same references.

In FIG. 3, it can be seen that the pivoting plate 20 and the fixed plate 21 of the pocket 2 are coupled to each other by the hinge shaft 22 provided for the pivoting plate 20. The hinge shaft 22 is centered on the thickness of the pocket at its rear end. Both plates 20 and 21 have fixing lugs such as 24 for fixing to the shaft 22, said lugs projecting from their respective inside faces close to their rear edges. The profile of the projecting portions of these lugs is semicircular. The lugs hold the plates to the shaft 22 and also hold the plates a small distance apart from each other.

The fixed plate 21 of the pocket 2 is also fixed by means of screws such as 25 to the top portion 5A of the frame in order to avoid any possible movement of the plate 21 about the shaft 22. The pivoting plate 20 is urged resiliently towards the plate 21 by a spring 26, with one end of the spring being fixed to the side edge of the plate 20 and its other end being fixed to the top portion 5A of the frame.

One of the two plates 20 and 21, in this case the plate 21, has a lateral spacer stud 21A at its end portion opposite to the shaft 22, thereby ensuring that the plates 20 and 21 retain the desired spacing apart against the action of the spring 26. In a variant, a pair of lugs with U-shaped branches may, simultaneously, fix the plate 21 on the top portion of the frame and prevent the facing faces of the plates 20 and 21 from being pressed together by the action of the resilient means urging the pivoting plate towards the fixed plate.

In the middle portion of each of the plates 20 and 21 there is a corresponding window 27A or 27B. A set of wheels 28A is mounted on the plate 20 in is window 27A and another set of wheels 28B is mounted on the plate 21 in its own window 27B. The wheels 28B carried by the fixed plate 21 project slightly proud from the inside face of said plate; the wheels 28A are flush inside the pocket with the inside face of the pivoting plate. These wheels 28A and 28B correspond so as to be face to face on the plates and make contacts with light pressure against each other inside the pocket 2. When a plurality of documents are being folded together, they ensure that the documents are clamped together and prevented from sliding relative to one another. The clamping is used to hold together multiple documents which are to be folded together, and in particular to enable small-format documents to be folded together with larger-format documents, thereby avoiding a possible additional source of jamming. These wheels projecting into the pocket 2 are advantageously closer to the access 23 than to the hinge axis 22 at the rear end of the pocket.

A pivoting finger 29 is mounted on the fixed plate 21 as an obstacle which is retractable merely by advancing the documents to be folded into the pocket 2. The finger 29 extends through the window 27B of the plate 21, or else through an additional individual window, and it penetrates into the corresponding window on the pivoting plate 20 while constituting an obstacle inside the pocket. It is retracted into its housing inside the plate 21 as shown by dotted lines whenever a document to be folded is present inside the pocket.

The finger 29 is coupled to a lever 29A which it actuates. The lever extends over the outside of the pocket 2. It serves as a detector for detecting the presence of a document inside the pocket 2. To this end, it is associated with a circuit (not shown) for detecting a jam inside the pocket 2, which circuit comprises a couple of cells for detecting the position of the lever and thus of the pivoting finger 29, together with a timer and a decision-making logic circuit. The timer is started by the couple of cells as soon as the finger 29 is retracted; the length of time it measures is selected to correspond to the maximum length of time that a document can be expected to remain inside the pocket as long as it is removed normally without causing a jam. When the pivoting finger returns to the obstacle position, the timer is reset to zero.

If the pivoting finger has still not returned to its obstacle position when the time delay of the timer has elapsed, then there is a jam and this is detected by the decision circuit.

The pocket 3 is similarly equipped. Its plates 30 and 31 have lugs 34 for holding them on hinge shaft 32. The fixed plate 31 is held by means (not shown) on the bottom portion 5B of the frame. A spring (not shown) urges the pivoting plate 30 towards the fixed plate 31. A lateral spacer stud 30A, this time mounted on the plate 30, or any other appropriate means ensures, together with the lugs 34, that the plates 30 and 31 remain at the desired distance apart. These plates have windows 37A and 37B in which wheels 38A and 38B are mounted and these wheels make contact with each other inside the pocket. The wheel 38B projects into the pocket, whereas the wheel 38A is merely flush with the plate 30. A pivoting finger 39 mounted on the fixed plate 31 forms a retractable obstacle inside the pocket 3. A lever 39A actuated by the finger 39 serves to detect the presence of a document inside the pocket 3 and it controls a jam detection circuit (not shown) for the pocket 3 which is analogous to the circuit for the pocket 2.

As a variant to the mechanical detector system 29 or 39 for detecting the presence of a document in each of the pockets 2 and 3, it would also be possible to fit each pocket with an individual or a common photoelectric detector 29', 39', as represented diagrammatically in FIG. 1. The emitting and detecting cells in each individual detector 29', 39' may be mounted on the plates of each pocket, or else outside the plates of each pocket and they may be coupled together, when there is no document present in the pocket, through appropriate windows in the plates. The emitting cell and the receiving cell of a common detector may be mounted on the fixed plates 21 and 31, of the two pockets 2 and 3. These cells are coupled through appropriate windows through the pivoting plates 20 and 30 of the pockets 2 and 3 when the folder is closed and in the absence of a document in either pocket.

At least one of the two plates in each pocket may be fitted with an abutment projecting from its inside face on each of the sides of the pocket serving to close the pocket sideways when the folder is itself closed. These abutments may also act as the above-mentioned spacer studs to ensure the desired spacing between the fixed plate and the pivoting plate, or they may overlie the sides of the plate facing the plate on which they are mounted.

A cable 50 for the pocket 2 mounted in the top portion 5A of the frame is fixed to an intermediate point of the pivoting plate 21 relatively close to the inlet 23 to the pocket, and also to a rear support 51 in the bottom portion 5B of the frame. Another cable 60 for the pocket 3 mounted in the bottom portion 5B of the frame is fixed to its pivoting pocket 30 and to a rear support 61 in the top portion 5A of the frame.

In addition, a closure flap 53 is mounted on the access end 23 of the pocket 2. This flap pivots between an open position (shown in dashed lines) and a closure position shown in solid lines. Depending on its position, this flap makes the pocket 2 of the folder available or not available. An abutment 62 is mounted inside the pocket 3. It constitutes an obstacle inside the pocket 3 located close to its end adjacent to the hinge axis 32. It is carried by the fixed plate 31 of the pocket. The position of this abutment is adjustable relative to the access 33 to the pocket 3 in the direction of arrow 63 and/or it may be mounted so as to be retractable on the fixed plate. Naturally, both pockets could be fitted with respective pivoting flaps for closing the accesses thereto, similar to the flap 53, and also both could be fitted with an abutment such as the abutment 62. An external control which may be individual or common (and which is not shown) is coupled to the flap 53 of the pocket 2 and to the abutment 62 of the pocket 3 in order to put the flap into the desired position depending on whether or not the pocket 2 is to be used, and to put the abutment into the appropriate corresponding position. The folder can thus be used for folding the documents it receives in three by using both pockets, or else for folding the documents in two by using only one of its two pockets, and in particular the pocket 3.

Figure 4:
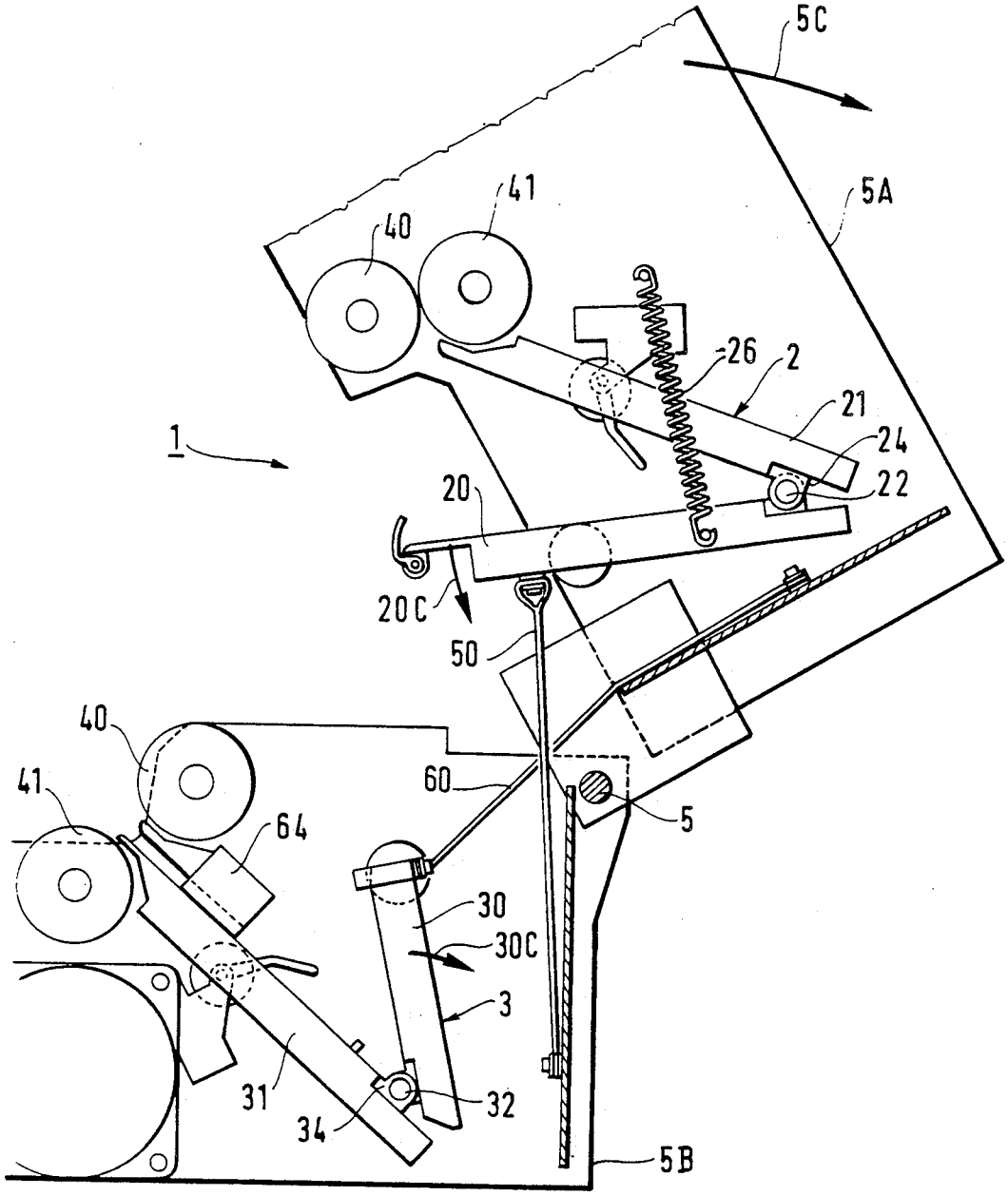
FIG. 4 corresponds to FIG. 3 for the open position of the folder with pockets.

FIG. 4 corresponds to FIG. 3 and shows the folder with the top portion 5A of its frame in the open position on the bottom portion 5B after pivoting in the direction of arrow 5C about the axis 5. The cables 50 and 60 fixed to the pivoting plates of the pockets 2 and 3 have then caused these pockets to be opened simultaneously with the folder being opened in the direction of arrow 5C.

Arrow 20C represents the pivoting of the pivoting plate about its axis 22. Arrow 30C represents the pivoting of pivoting plate 30 about its plate 32.

As shown in FIGS. 3 and 4 with respect to the pocket 3, whose associated peripheral folding rollers 42 and 43 are mounted together therewith in the bottom portion of the frame, the pivoting plate 30 is truncated and does not extend all the way to the folding rollers 42 and 43. A small auxiliary backing-plate 64 replaces the truncated terminal portion of the pivoting plate 30. This auxiliary backing-plate 64 is fixed in the bottom portion 5B of the frame. It is used to define the access to the pocket 3 in association with the facing portion of the fixed plate 31. The pivoting plate 30 with its truncated terminal portion can thus escape freely from the folding roller 42 when the folder is opened, thereby opening the pocket 3.

With reference to FIGS. 3 and 4, it can also be seen that the plates 20 and 21 and 30 and 31 are of sufficient thickness to enable the various components fitted to each of the pockets and carried by these plates to be mounted thereon. The end portions of the plates 20, 21, and 31 and of the counter plate 64 defining the accesses 23 and 33 to the pockets are narrower so that their external faces do not contact the folding rollers 41 and 42 and 42 and 43, thereby enabling the accesses 23 and 33 to these pockets to be properly interposed between these rollers.

A motor 7 drives the folding rollers 40 to 43 and the rollers or wheels on the inlet path 10 and on the outlet path 11 of the folder. The motor 7 is coupled to the roller 43 which itself drives the roller 40 either by friction or by meshing teeth, when the folder is closed as shown in FIG. 3 and put into operation. The roller 40 in turn imparts identical drive to the rollers 41 and 42.

The operation of the folder is unaltered by the particular way in which its set of rollers is mounted, in part in the top portion of the frame, and with the other part being mounted in the bottom portion of the frame, nor is its operation affected by the particular structure of its pockets. The rollers 40 and 41 drive the document to be folded and insert it into open pocket 2. Advance of the document into the pocket is stopped by the lugs 24 at the rear of the pocket or by an internal abutment with which it may be fitted, thereby buckling the document in front of the access 23. This buckle is taken up by the rollers 40 and 42, thereby forming a first fold and also inserting the document into the pocket 3, first fold foremost, with the document then being removed from the pocket 2 and with the remainder thereof continuing to be driven by the rollers 40 and 41. The second fold is obtained in the same manner and the document folded in three is evacuated via the rollers 40 and 43 onto the outlet path. The pivoting finger in each pocket retracts when there is a document level therewith and returns to its obstacle position when the document is removed therefrom. The wheels projecting into the pockets upstream from the fingers serve to press together the documents inside the pocket as they move into or out from the pocket. If either finger remains for too long in its retracted position, then a jam has occurred. This causes the folder to stop. Such a jam can then quickly and easily be cleared by opening the folder.

In order to obtain only one fold, access to one of the pockets is closed. The single fold is then obtained using the other pocket.

The present invention has been described with reference to the example shown. Naturally, detail modifications and adaptations can be made thereto in particular with respect to the disposition of the pockets facing the associated set of folder rollers, without thereby going beyond the scope of the present invention.

We claim:

1. In a folder with pockets comprising two portions, a bottom portion and a top portion hinged to the bottom portion for opening purposes, an inlet for sheets to be folded in said top portion and an outlet for folded sheets in said bottom portion, a set of folding rollers receiving the sheets to be folded from said inlet and delivering them folded on an outlet path leading to said outlet;

a first pocket in the top portion and a second pocket in the bottom portion, each pocket having a sheet access adjacent to said set of rollers;

the improvement wherein said folder is constituted by a frame forming said top portion and said bottom portion of the folder, said set of rollers has a first portion of its rollers mounted in the top portion of the frame and a second portion of said rollers mounted in the bottom portion of the frame, defining said outlet path for folded sheets directly between the top and bottom portions of the frame, such that said set of rollers separate from each other on being opened, and said outlet path opens when the frame is opened.

2. In a folder with pockets comprising two portions, a bottom portion and a top portion hinged to the bottom portion for opening purposes, an inlet for sheets to be folded in said top portion and an outlet for folded sheets in said bottom portion, a set of folding rollers receiving the sheets to be folded from said inlet and delivering them folded on an outlet path leading to said outlet;

a first pocket in the top portion and a second pocket in the bottom portion, each pocket having a sheet access adjacent to said set of rollers;

the improvement wherein said folder is constituted by a frame forming said top portion and said bottom portion of the folder, said set of rollers has a first portion of its rollers mounted in the top portion of the frame and a second portion of said rollers mounted in the bottom portion of the frame, defining said outlet path for folded sheets directly between the top and bottom portions of the frame, such that said set of rollers separate from each other on being opened, and said outlet path opens when the frame is opened, and wherein said first and second pockets are each defined by a fixed wall and a facing pivoting wall such that the pockets open when the top portion of the folder is opened, wherein each of said first and second pockets is constituted substantially identically and independently of its frame portion, by a pair of plates coupled to each other about an end hinge axis opposite from the access to the pocket, and wherein each pocket further includes:

first means for fixing said plate of the pocket constituting the fixed wall to the frame; second means resiliently urging the other plate forming said pivoting wall against the fixed wall; and third means for separating facing faces of each pair of plates to prevent them from touching one another.

3. A folder with pockets according to claim 2, further including at least one first wheel mounted on at least one of the plates of each pocket and projecting against the other plate of the pocket.

4. A folder with pockets according to claim 3, further including at least one second wheel carried by the other one of said plates in each pocket, lying flush with the inside face of the pocket and receiving the first projecting wheel thereagainst.

5. A folder with pockets according to claim 2, wherein said separation means comprise lugs projecting from the facing faces of the plates of each pocket, and serving to hold the plates relative to the end hinge axes.

6. A folder with pockets according to claim 5, wherein said separation means further include at least one lateral separator stud on one of the plates, and projecting towards the other plate.

7. A folder with pockets according to claim 2, wherein the fixed plate of each pocket carries a pivoting finger mounted as an obstacle retractable by the document inside the pocket as coupled to an element outside the pocket for detecting the presence of a document inside the pocket.

8. A folder with pockets according to claim 2, further including a photoelectric detector for detecting the presence of a document in the pockets.

9. A folder with pockets according to claim 8, wherein said photoelectric detector is common to both said first and second pockets, and is constituted by an emitting cell and a detecting cell coupled optically to each other through both pockets in the absence of a document in either pocket.

10. A folder with pockets according to claim 2, wherein the pivoting wall of each said pockets is the plate which is situated adjacent to the portion of the frame which does not include the pocket in question, wherein the folder includes pocket-opening cable means for opening each of the pockets, said cable means being fixed at one end to the pivoting wall of the pocket and at the other end to a support mounted in that portion of the frame which does not include the pocket in question, said cable means causing the pocket to be opened when the top portion of the frame is opened relative to the bottom portion therefore, and against the action of resilient means coupled to the pivoting plate of the pocket.

* * * * *